United States Patent [19]

Dolza, Sr.

[11] 4,080,948

[45] Mar. 28, 1978

[54] SPLIT ENGINE CONTROL SYSTEM

[76] Inventor: John Dolza, Sr., 810 State St., Fenton, Mich. 48430

[21] Appl. No.: 762,361

[22] Filed: Jan. 25, 1977

[51] Int. Cl.[2] ..... F02D 13/06

[52] U.S. Cl. ..... 123/198 F

[58] Field of Search ..... 123/198 F, 127, 97 B; 261/23 A

[56] References Cited

U.S. PATENT DOCUMENTS

| | | | |
|---|---|---|---|
| 2,315,183 | 3/1943 | Bichnell et al. | 123/198 F |
| 2,623,617 | 12/1952 | Snyder et al. | 123/198 F X |
| 2,757,651 | 8/1956 | Winkler | 123/198 F X |
| 2,878,798 | 3/1959 | Dolza et al. | 123/198 F X |
| 2,947,298 | 8/1960 | Dolza | 123/198 F X |
| 3,578,116 | 5/1971 | Nakajma et al. | 123/198 F X |
| 3,698,371 | 10/1972 | Mitsuyama et al. | 123/198 F |
| 4,019,479 | 4/1977 | Garabedian | 123/198 F |

*Primary Examiner*—Charles J. Myhre
*Assistant Examiner*—Ira S. Lazarus
*Attorney, Agent, or Firm*—Reising, Ethington, Barnard, Perry & Brooks

[57] ABSTRACT

A charge forming system including an intake manifold having first passage means communicating with one-half of the engine combustion chambers; second passage means communicating with the other half of the engine combustion chambers; an air metering mechanism having passage means for respectively supplying a combustible fuel/air mixture or metered air to the first and second manifold passage means; and a control device disposed between the air metering mechanism and the intake manifold for controlling flow to the first manifold passage whereby the engine may operate on the power from one-half of its cylinders under low engine load conditions.

20 Claims, 24 Drawing Figures

SPLIT ENGINE CONTROL SYSTEM

BACKGROUND OF THE INVENTION

The present invention relates to a control system for an internal combustion spark ignition engine which permits the engine to be run on less than all of its cylinders in order to achieve substantial economies in engine operation. Such a capability is sometimes referred to as "split-engine" operation through which it is possible to operate on one-half of the cylinders of an engine having an even number of cylinders. For example, with the present invention it is possible to operate on four cylinders of an eight-cylinder engine.

Engine operation is more economical if each cylinder of the engine is run under relatively high loads. However, under a large percentage of vehicle operating conditions the engine is operating under relatively light loads resulting in uneconomical fuel consumption. Accordingly, it is desirable to operate the engine on half of the cylinders during normal or light load operation with the remaining cylinders being brought into operation only after the load on the engine exceeds a given value. In this way it is possible to increase the load on each of the active cylinders and in that way achieve greater overall operating economies for the engine.

More specifically, to operate an engine at part load it has to be throttled and thus produces a manifold vacuum the production of which wastes a significant portion of the engine power. This is referred to as "throttling losses". On the other hand, operating an engine on one-half of its cylinders requires less throttling thereby reducing the vacuum produced and, in turn, greatly reducing "throttling losses". Also, during half-cylinders-operation combustion takes place in only the "active" cylinders as a result of which considerably less heat radiating surfaces are dissipating the combustion energy.

PRIOR ART DEVICES

In the past it has been extremely difficult to achieve split or half engine cylinders operation in such a manner as to make the transition between all- and half-cylinders-operation smooth enough to be acceptable to an operator. It has also been difficult in practice to achieve the theoretically expected fuel economy and particularly in view of the now mandated emission control requirements.

In my prior U.S. Pat. No. 2,878,798 entitled "Split Engine" there is shown a mechanism for achieving engine operation utilizing either all or half of the engine cylinders. When operating on half of the engine cylinders it is important that the "inactive" cylinders be open to the atmosphere in order to avoid undesirable throttling losses. In the case of my aforementioned patent, the avoidance of such throttling losses in the "inactive" cylinders was achieved through the use of a complicated throttle control mechanism requiring differential control of the throttle valves serving the "active" and "inactive" cylinders. Such differential throttle control was achieved by the relatively costly and complicated control system whereby the "inactive throttle" was moved to a wide open position during half-cylinders-operation. In my earlier patented system it was not only deemed necessary to move the "inactive throttle" to a wide open position during split engine operation, but it was also deemed necessary to reposition the "active throttle". Such a system was both complicated to build and subject to misadjustment during operation. Further, the close coordination between "active" and "inactive" throttle positions was critical to a smooth transition between all and half-cylinders-operation. Such differential throttle control has been eliminated in the subject invention.

SUMMARY OF INVENTION

Test results to date indicate improvements in fuel economy of 15–25% where the subject split engine control device has been installed on an automobile. Furthermore, this gain in fuel economy has been achieved with a reduction in carbon monoxide and hydrocarbon emissions.

Those prior type control systems of which I am aware utilized to achieve split engine operation have required such system to be installed as original equipment with the engine. In the present invention I have developed a greatly simplified split engine control system which may not only be installed as original equipment but may also be utilized to retrofit existing engines and thereby convert the same to a split engine capability. In a typical two-barrel carburetor wherein each barrel of the carburetor supplies a combustible fuel/air mixture to one-half of the engine cylinders, a throttle valve is provided in each barrel of the carburetor and the valves are normally fixed to a common shaft so as to be rotatable or adjustable in unison. Since the present invention does not require differential actuation of two or more throttle valves, the split engine control device is not only less expensive to manufacture but is also usable with conventional single or multi-barrel carburetors as well as with fuel injection systems and gaseous fuel mixers.

The split engine control device of the subject invention is housed in a thin housing adapted to be interposed between the engine intake manifold and the carburetor. Since no structural modifications are required in either the manifold or carburetor, the subject control device may readily be installed on an engine which did not originally have such a split engine capability.

With an engine embodying such a split engine control device, one-half of the engine cylinders ("active") are always in open communication with the intake manifold and all of the fuel/air mixture or metered air from the carburetor. The other half of the engine cylinders ("inactive") are adapted to be blocked by a suitable split engine control valve to prevent the flow of a combustible fuel/air mixture or metered air to these cylinders even though the throttle valve position would normally permit such flow. The present invention relates to the construction and control of the split engine control valve which is hereinafter referred to as a "shuttle valve". The shuttle valve has three basic functional positions the movement between which is controlled by a combination of manifold vacuum in the "active" cylinder manifold, a biasing force acting in opposition to the vacuum force and means for releasably retaining the valve in either of its all- or half-cylinders-operating positions. In a first position the shuttle valve permits open communication between the carburetor and the inlet to the "inactive" cylinders manifold whereby all-cylinders-operation (ACO) can take place as is necessary when the engine is heavily loaded. Under light engine loading conditions the shuttle valve is shiftable to a second position wherein communication is blocked between the carburetor and the "inactive" cylinders manifold and thereby permitting split or half-cylinders-operation (HCO). In such second position, the shuttle valve also communicates the inactive cylinders manifold to ambient or atmospheric pressure to reduce throttling losses. The shuttle valve has a third or transient position between the first and second positions wherein the "inactive" cylinders are not only blocked from receiving a combustible fuel/air mixture from the carburetor, but such cylinders are also substantially blocked from communication with the ambient atmosphere. This third or transitional position of the shuttle valve facilitates a smooth transition between all-cylinders-operation and half-cylinders-operation.

As will be apparent from the detailed description which follows, the split engine control system of the subject invention includes numerous ancillary structural features and mechanisms for facilitating control of the shuttle valve and the various forces to which the same is subjected.

Since the split engine shuttle valve is subject to numerous variable forces and conditions which can and do affect its operation, the subject invention includes various devices which insure the precise actuation and sequencing of the valve and also prevent the valve from hunting between its various positions during the transition between all- and half-cylinders-operation. As an example, a pair of magnetic devices or, alternatively, detent mechanisms are provided to cause the shuttle valve to dwell or be retained in either of its extreme positions to which it will have been shifted by the differential effect of manifold vacuum and an opposing biasing force. Further, the split engine control device includes an "active" cylinder manifold vacuum reservoir system for stabilizing the controlling vacuum signal and which system also includes secondary valve means for modifying the vacuum force acting on the shuttle during transient operating conditions.

It is to be understood that the present invention is applicable to all types of carburetted, fuel injected and the like types of engines so long as there are at least two cylinder combustion chambers. Not only is the invention applicable to a conventional piston engine but it may also be applied to a so-called "rotary" or Wankel type engine utilizing at least two rotors supplied by separate intake manifolds. Thus, the hereinafter use in the specification and claims of words such as "internal combustion engine", "cylinders", "pistons" and the like, is meant to comprehend rotary type engines and their functionally equivalent or related components such as "combustion chambers", "rotors" and the like. Likewise, reference to an "air metering mechanism" shall include carburetors, fuel injection systems or the like wherein the flow of combustion air is throttled or metered by suitable throttle valve means to control engine power output.

The details of the subject invention will now be described in conjunction with the following drawings.

FIG. 1 is a cross-sectional elevation view showing the split engine control device positioned intermediate a carburetor and an intake manifold;

FIG. 1*a* illustrates a single throttle for controlling air flow through the air metering mechanism.

FIG. 2 is a plan view of the split engine control device taken along lines 2—2 of FIG. 1;

FIG. 2*a* is a detail view of an atmospheric vent valve in various operative positions;

Figure 2:
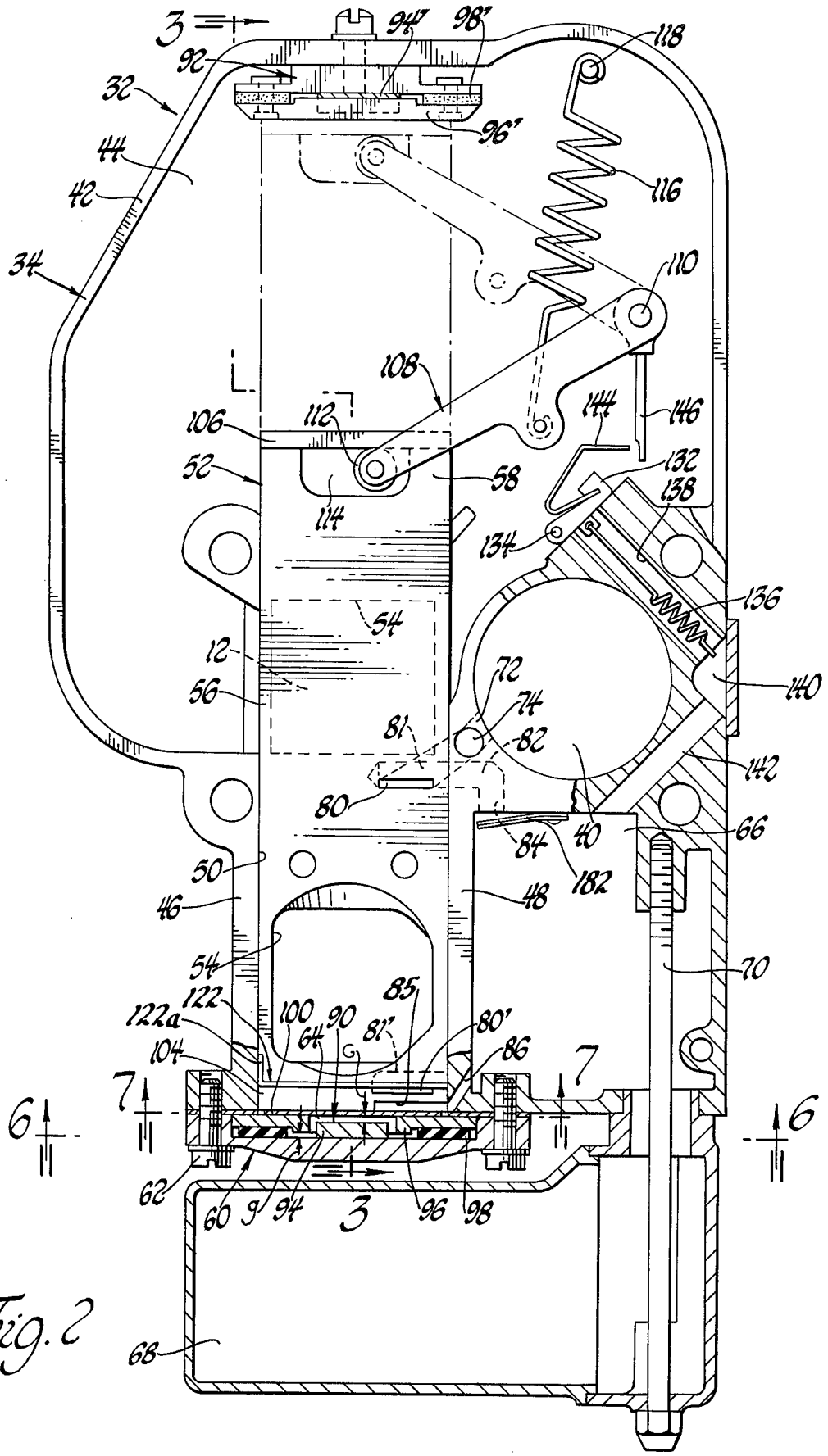
Figure 6:
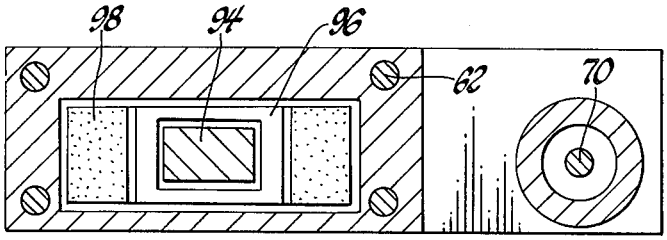
FIG. 6 is a view along lines 6—6 of FIG. 2.
Figure 6A:
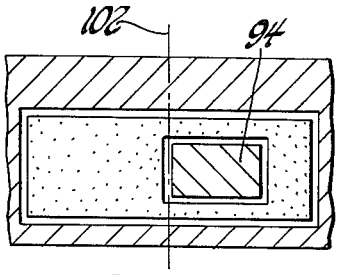
Figure 7:
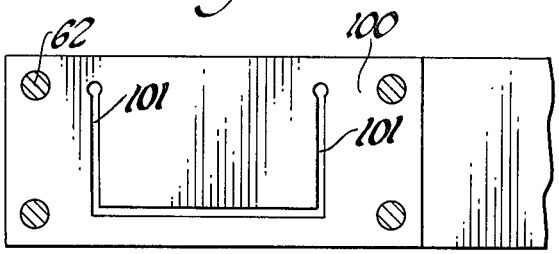
Figure 8:
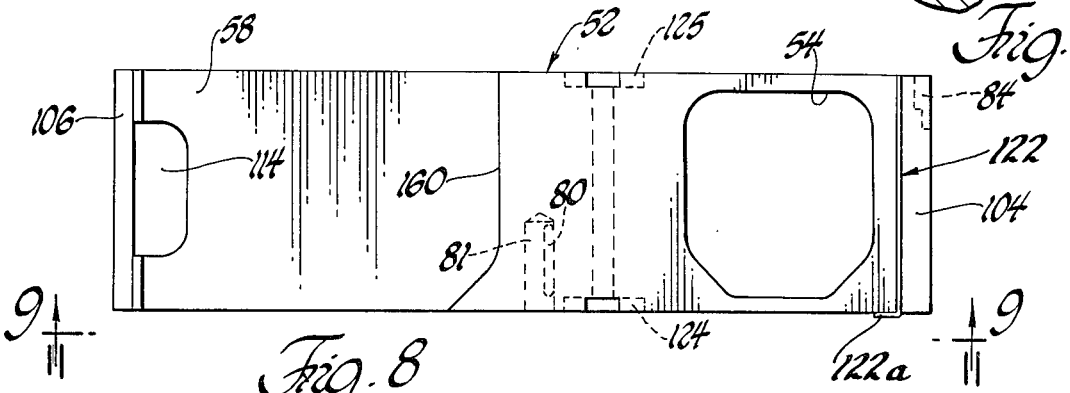
Figure 9:
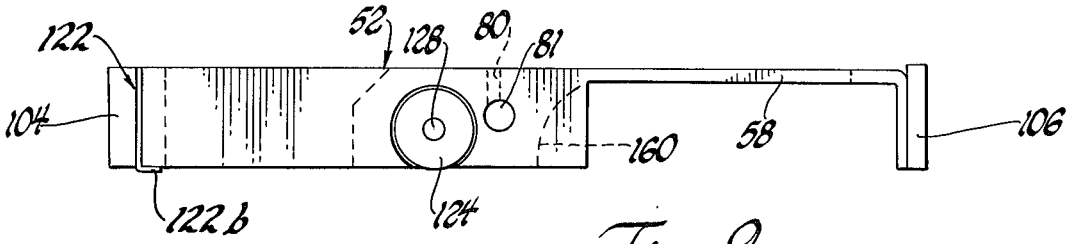
Figure 10:
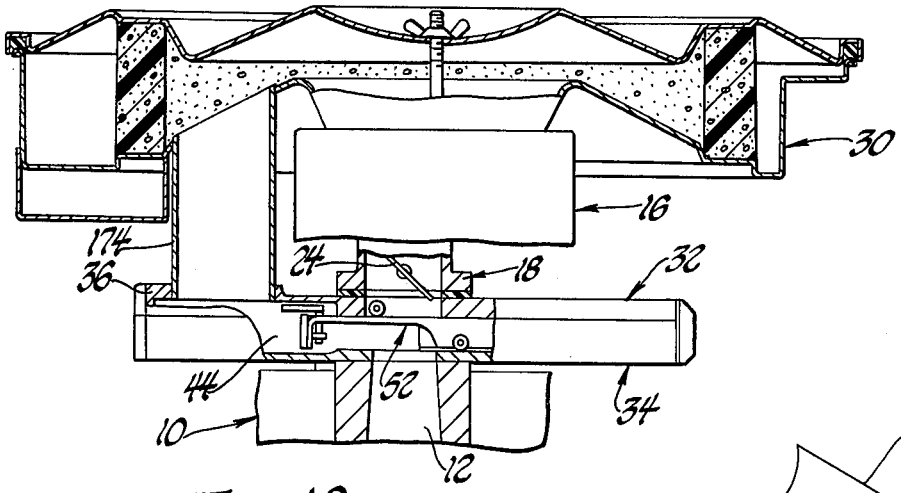
Figure 11:
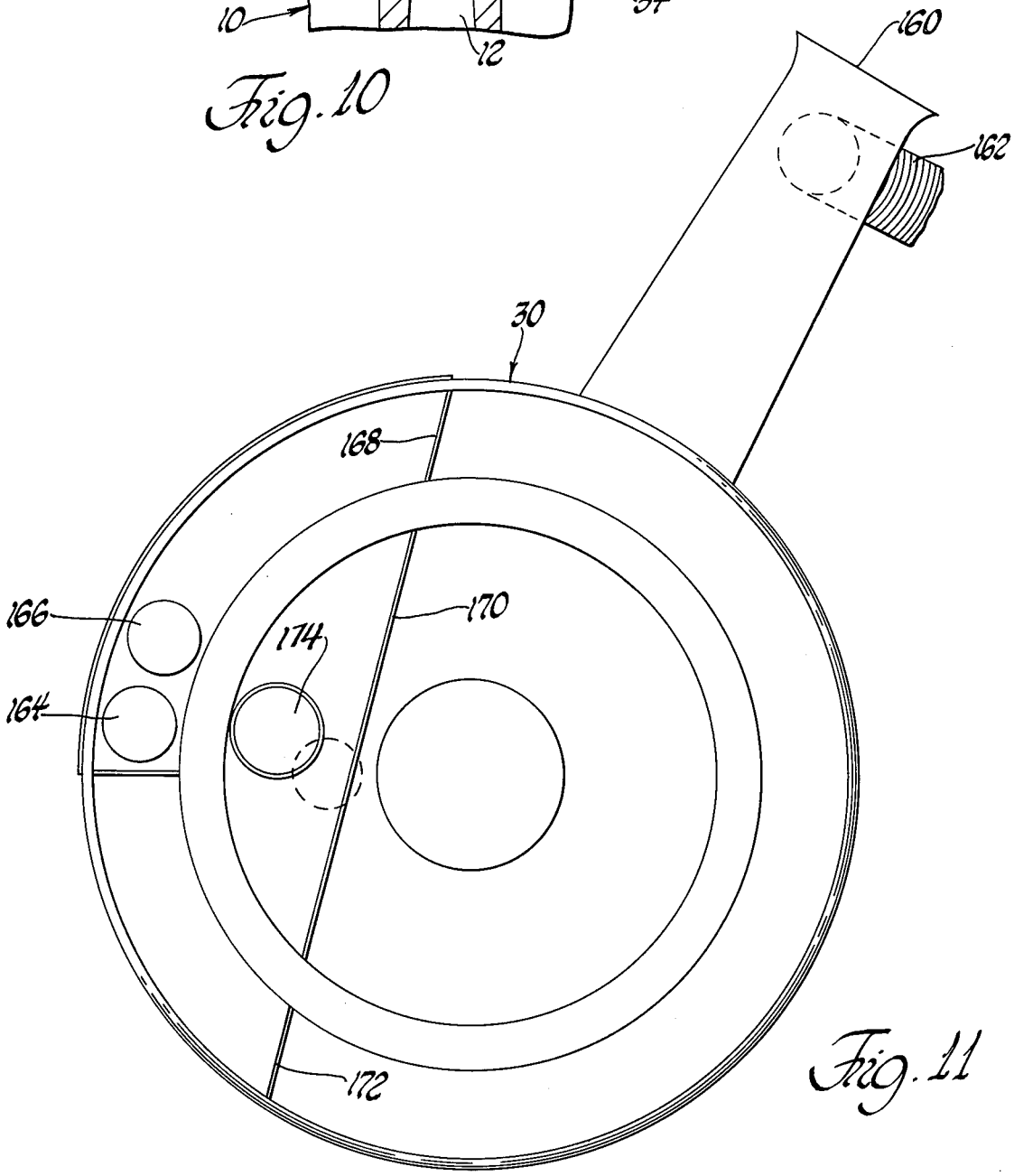
Figure 12:
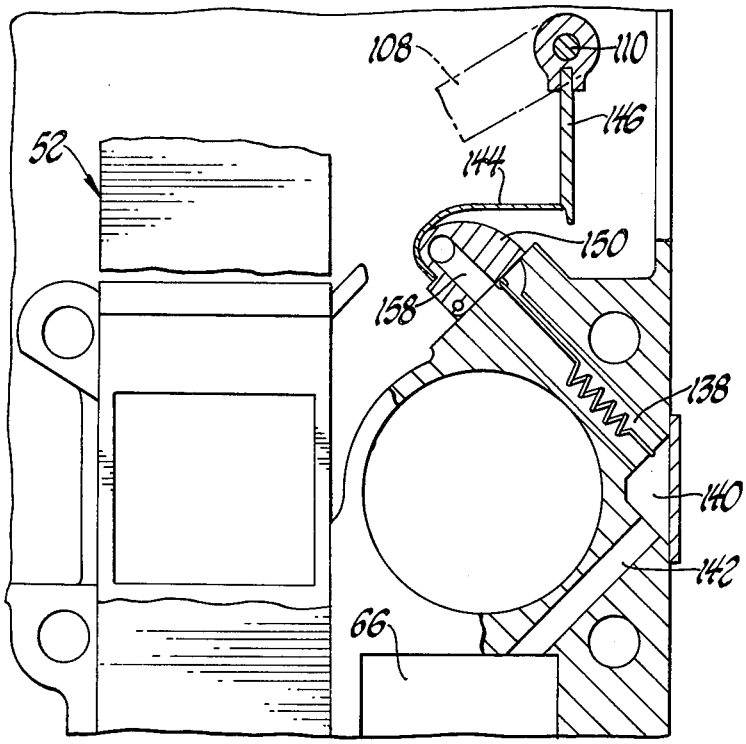
Figure 13:
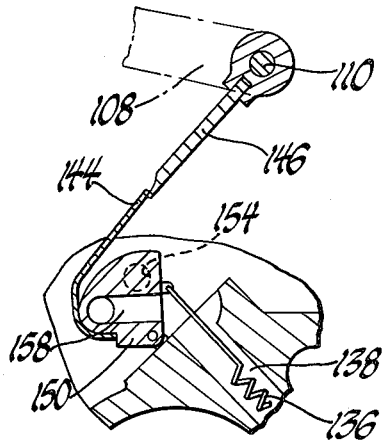
Figure 14:
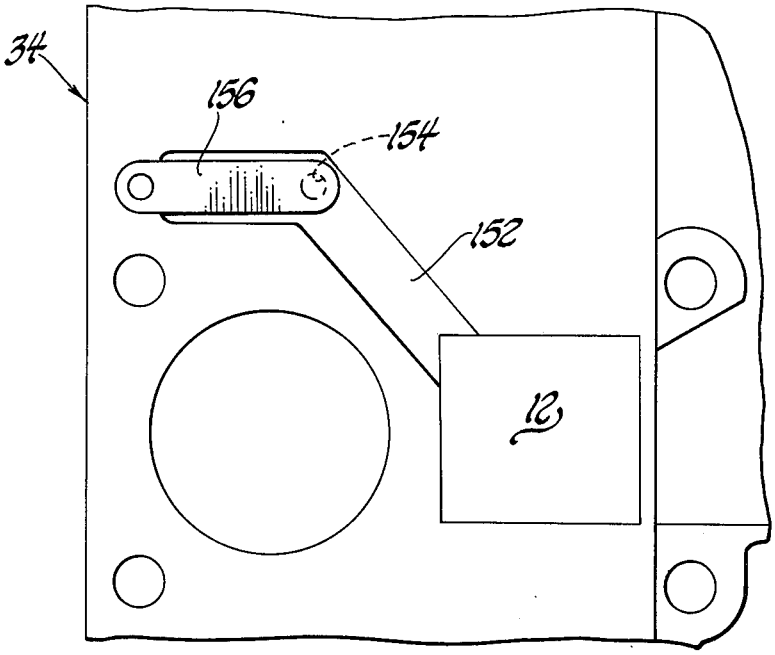
Figure 15:
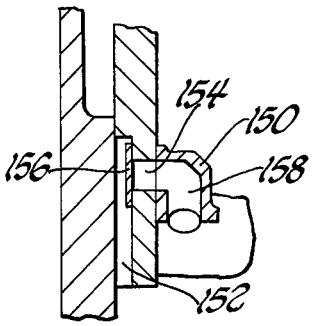
Figure 19:
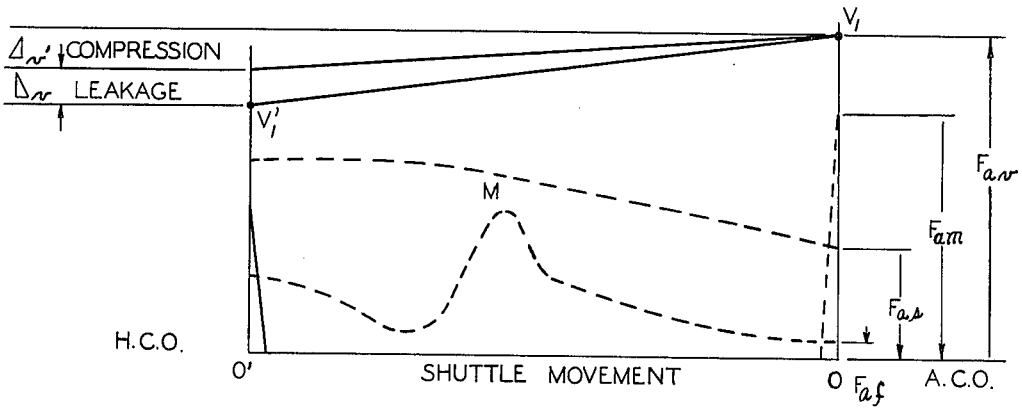
Figure 20:
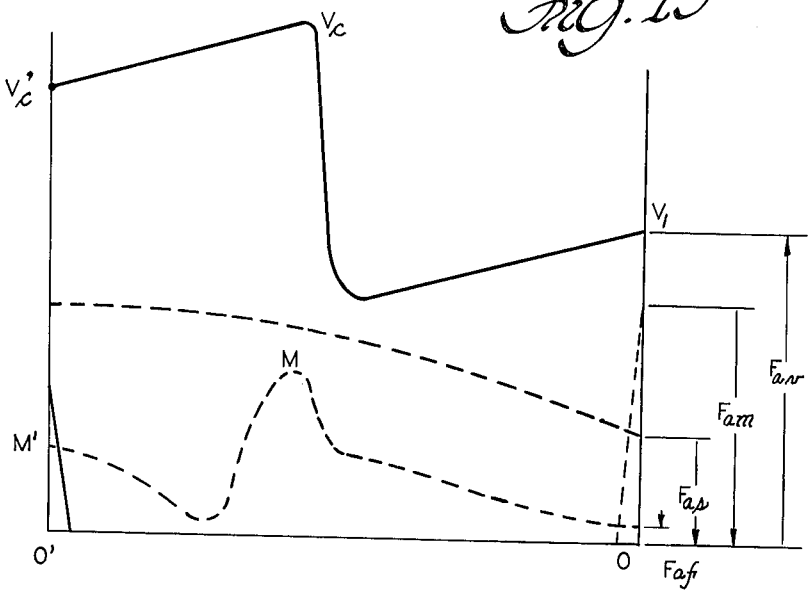
Figure 21:
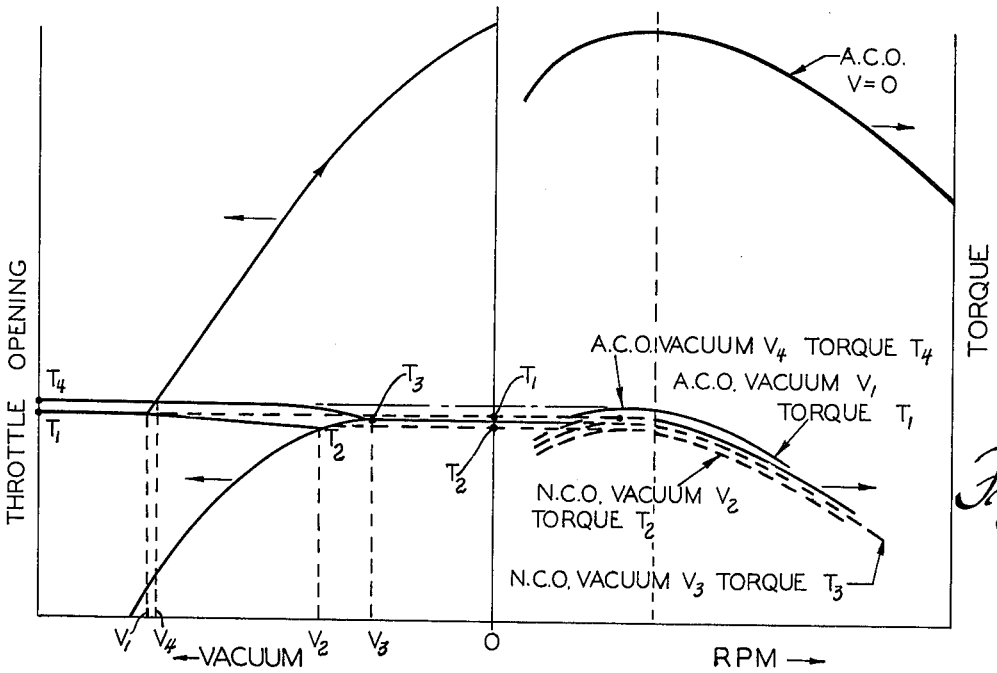

FIG. 6*a* is a modification in the positioning of the parts shown in FIG. 6;

FIG. 7 is a view along lines 7—7 of FIG. 2;

FIG. 8 is a bottom view of the shuttle valve;

FIG. 9 is a side elevational view of the shuttle valve turned end-for-end from the view of FIG. 8;

FIG. 10 is a partially sectioned elevational view of that portion of an engine incorporating the subject invention;

FIG. 11 is a plan view of an air cleaner utilized with the subject invention;

FIGS. 12–15 of the invention relate to a modified construction utilizing a double-acting valve for increasing the resultant force acting on the shuttle valve;

FIGS. 16–20 are graphs which depict the various magnetic, vacuum, spring and frictional forces active on the shuttle valve; and FIG. 21 is a graph depicting the engine torque relationships in shifting from all- to half-cylinders-operation.

Figure 1:
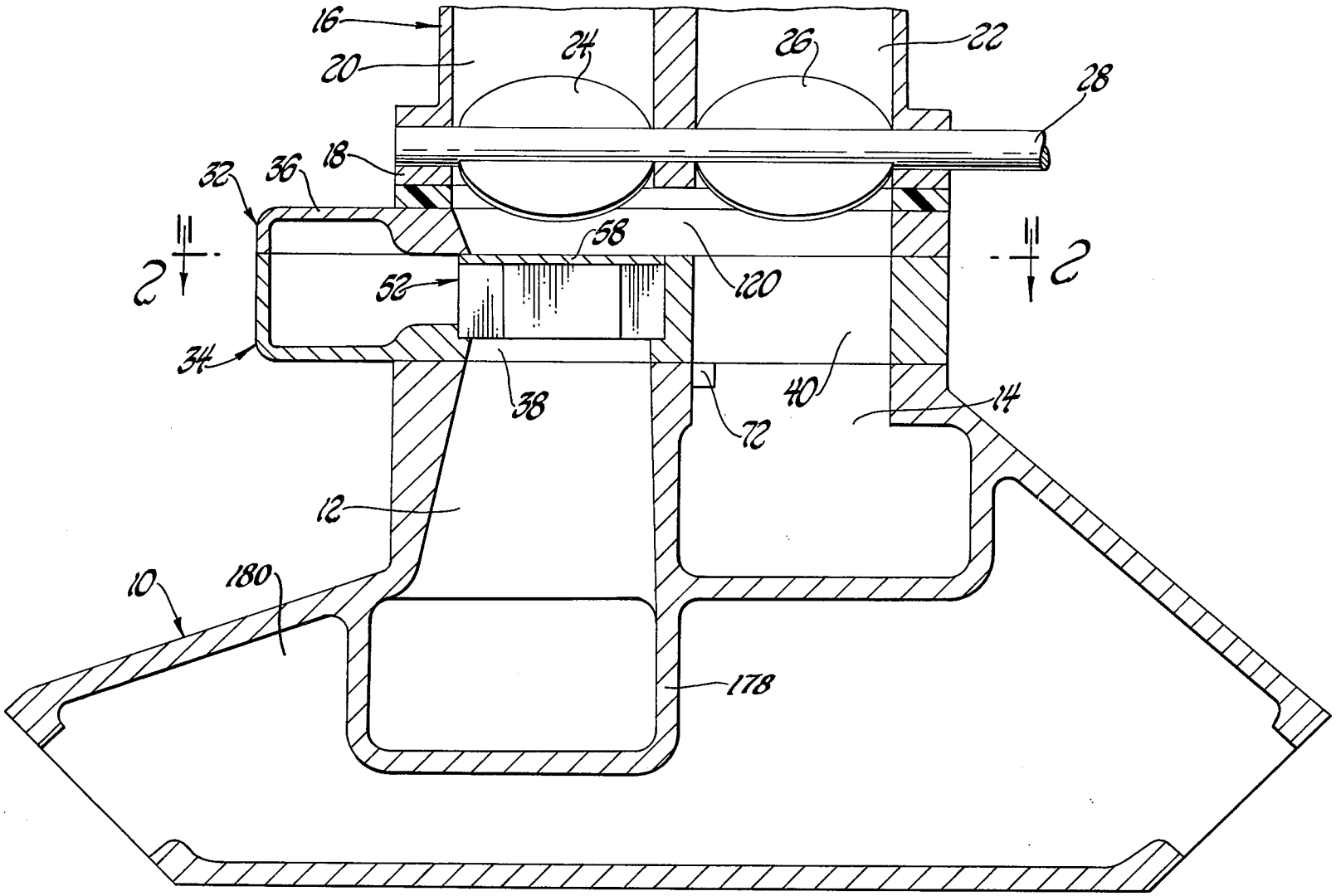
Figure 1A:
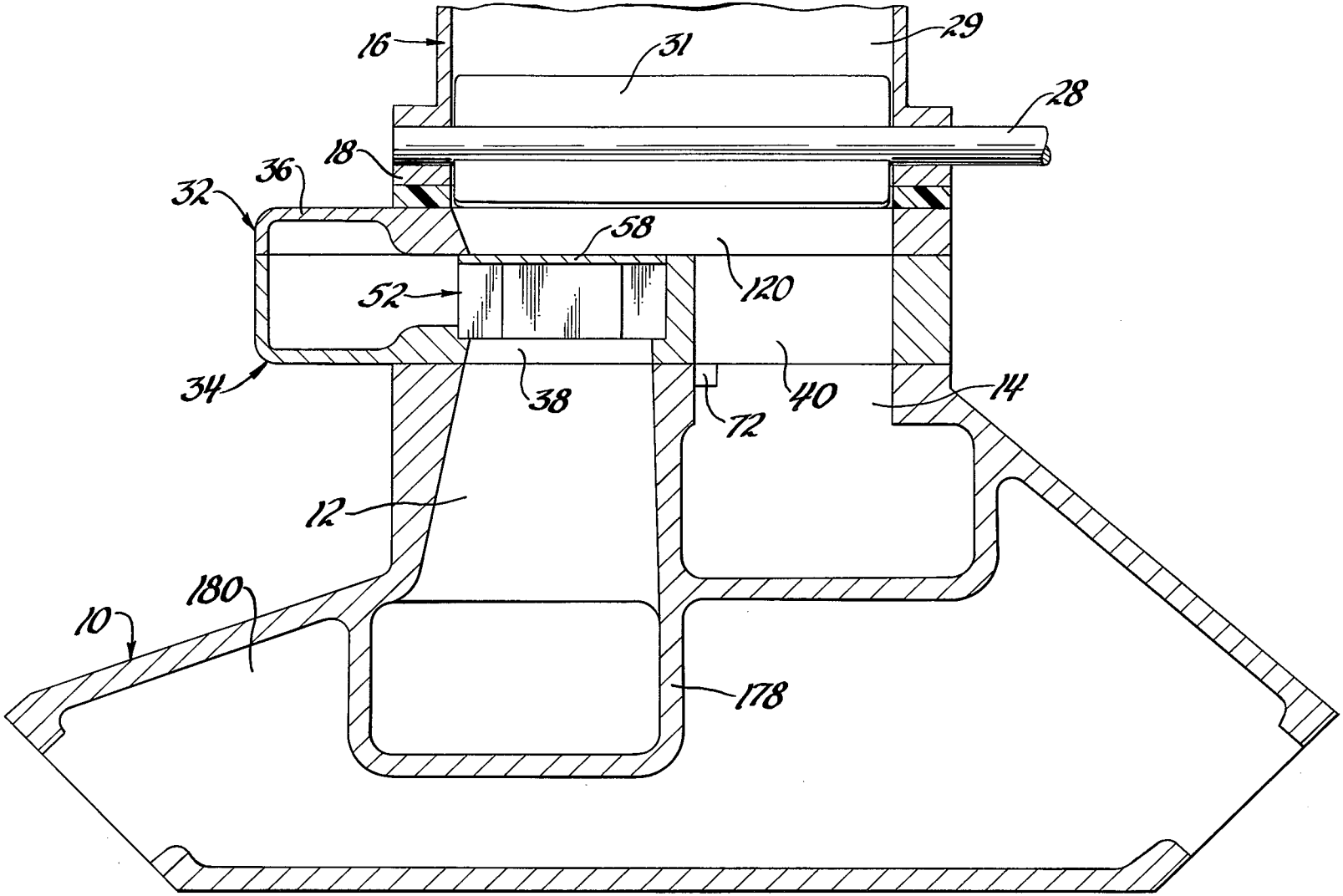

Referring to FIGS. 1, 1*a* and 2 of the drawings, an engine intake manifold is indicated generally at 10 and includes a pair of intake manifold passages 12 and 14. Depending on whether all- or half-cylinders-operation is required, passage 12 is adapted to supply either atmospheric air or metered air to the combustion chambers of one-half of the cylinders of the engine. Manifold passage 14 supplies metered air to the combustion chambers of the other half of the cylinders under all engine operating conditions. In other words, those cylinders supplied by manifold passage 14 always receive metered air with which fuel is combined and thus supply power under both all- or half-cylinders-operation, whereas those cylinders fed by manifold passage 12 only receive metered air and fuel during all-cylinders-operation and otherwise do not generate power. For convenience, the engine cylinders fed by manifold passage 14 are termed the "active" cylinders while those fed by manifold passage 12 are termed the "inactive" cylinders even though the latter supply power during all-cylinders-operation.

The lower portion of air metering device or carburetor 16 is indicated generally at 18 and in the embodiment of FIG. 1 includes a pair of intake passages 20 and 22 adapted respectively to supply a combustible mixture or metered air to both manifold intake passages 12 and 14 or to passage 14 alone. Flow through carburetor intake passages is controlled by a pair of throttle valves 24 and 26 fixed on a common operating shaft 28 adapted to be controlled by an accelerator control linkage mechanism not shown. Alternatively as shown in FIG. 1*a*, carburetor 16 may include a single intake passage 29 the flow through which is controlled by a single throttle 31. As seen in FIG. 10, an air cleaner 30 is adapted to be mounted upon carburetor 16 to provide filtered air to the carburetor.

A split engine control device is indicated generally at 32 and is adapted to be mounted between carburetor 16 and intake manifold 10. Control device 32 includes a main housing 34 and an upper casing or cover 36 which are formed so as to provide a pair of flow control passages 38 and 40 respectively aligned with a common passage 120 fed by carburetor intake manifold passages 20-22 or single intake passage 29. Passages 39 and 40 are, in turn, aligned with manifold passages 12 and 14. Common passage 120, control device passage 40, and manifold intake passage 14 are adapted to supply metered air to the "active" engine cylinders which are always in operation. On the other hand, common passage 120, control device passages 38 and 54, along with manifold intake passage 12 are adapted to supply metered air to the "inactive" engine cylinders only when all-cylinders-operation is required and depending on the operating condition of control device 32.

In other words, when the demands on the engine are such that all cylinders must be operating to supply the needed power, metered air will be supplied to one-half of the cylinders through passages 120, 40, and 14 while the other half of the cylinders are supplied by passages 120, 38, 54, and 12. On the other hand, under conditions of light engine loading wherein the power demands can be met by only half of the engine cylinders, control device 32 is adapted to shut off the flow of metered air to manifold intake passage 12.

Reference is now made particularly to FIGS. 2–5 of the drawings. Split engine control device housing 34 includes an enlarged end portion circumscribed by housing wall 42 and which, together with cover 36, define an atmospheric chamber 44. Housing 34 includes a smaller portion defined by walls 46 and 48 which coact to define an internal straight-sided guideway 50 within which a shuttle valve member 52 is slidably disposed. Shuttle valve 52 is disposed above and is adapted to control the flow through manifold intake passage 12. As best seen in FIGS. 1 and 3–5 of the drawings, shuttle valve 52 is disposed immediately subadjacent carburetor throttle blade 24.

The structural details of shuttle valve 52 are shown particularly in FIGS. 2–9. As seen in FIGS. 1 and 3–5, control device cover 36 coacts with housing 34 in such a way as to enclose atmospheric chamber 44 and the shuttle operating mechanism. More particularly, cover 36 coacts with the shuttle valve guide walls 46, 47, and 48 to provide a piston-like chamber within which the shuttle is slidably disposed.

Figure 3:
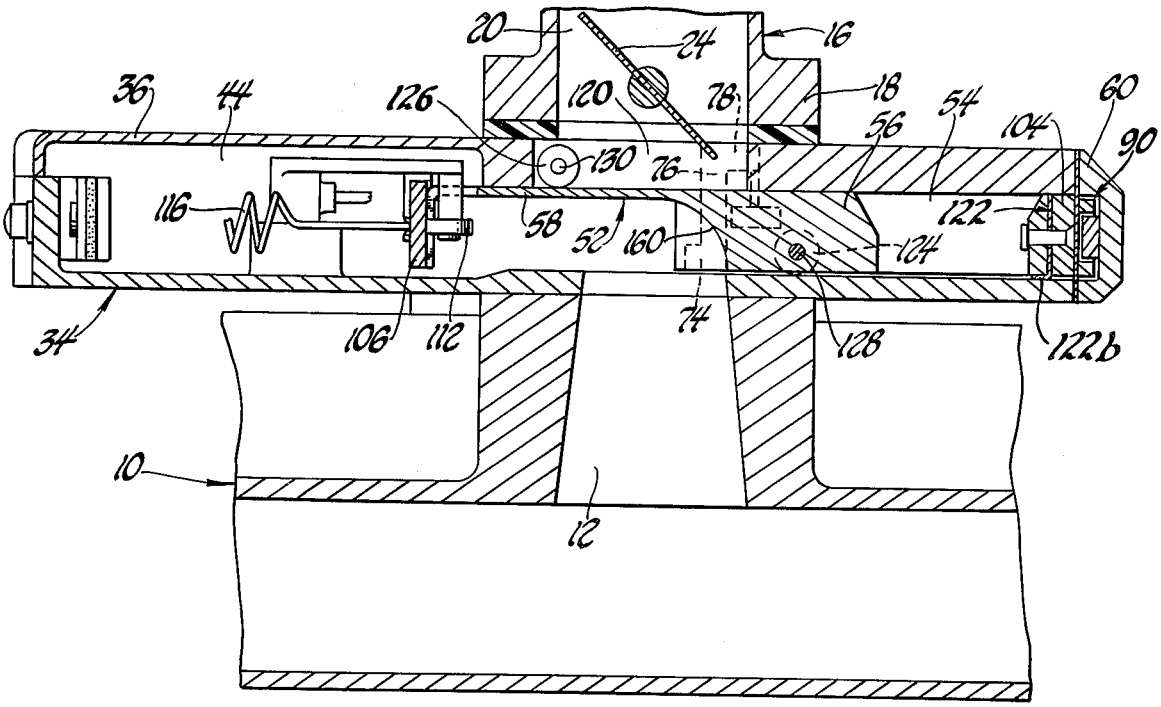
FIGS. 3–5 are sectional views taken at 90° to the view of FIG. 1 and showing the shuttle valve in its various operative conditions.
Figure 4:
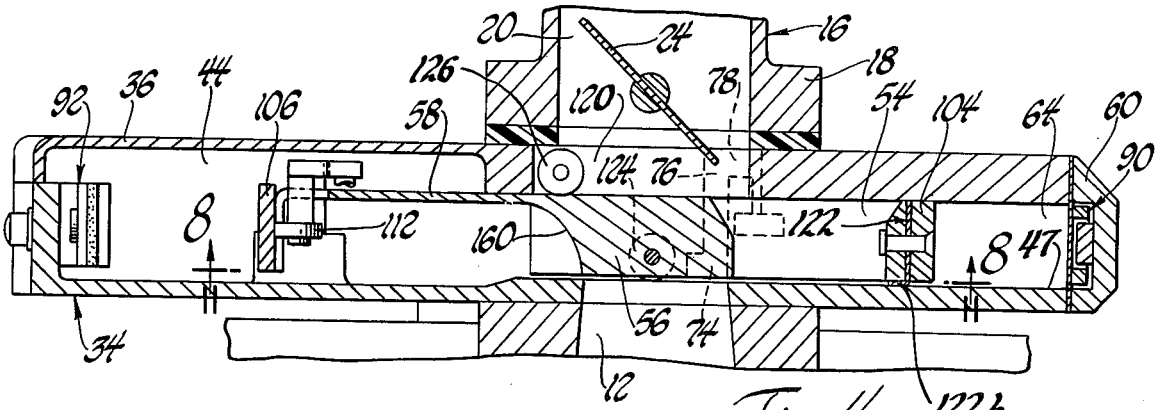
Figure 5:
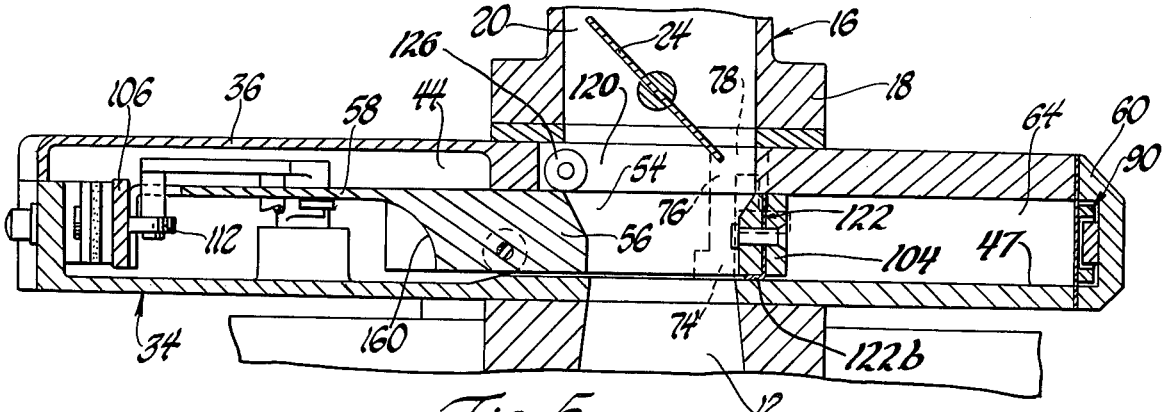

Referring particularly to FIGS. 3–5, shuttle 52 includes three distinct portions adapted in various ways to control the flow through manifold intake passage 12. A first end portion of the shuttle valve includes an opening or passage 54 which corresponds in general cross-sectional shape and size to the inlet of manifold intake passage 12. The next portion of shuttle 52 is indicated at 56 and is of a solid cross-section and again corresponds generally in size to the inlet of manifold intake passage 12. The third portion of shuttle 52 is an overhang or lip 58 which is adapted to prevent the flow of metered air from common passage 120 to the intake manifold passage 12 while permitting the latter passage to communicate with atmospheric chamber 44 of housing 34.

The means will now be described by which shuttle 52 is moved to cause the various portions 54, 56, and 58 thereof to coact with manifold intake passage 12 to control the transition between half and full cylinder engine operation.

As best seen in FIG. 2, the outer end of shuttle guide 46-48 is enclosed by a cap member 60 suitably retained against housing 34 and cover 36 by screw members 62. Cap 60 and the adjacent end of shuttle 52 form a vacuum chamber indicated generally at 64 and adapted to be communicated through a series of chambers and passages with manifold intake passage 14 whereby chamber 64 is responsive to the vacuum in the manifold intake passage serving those engine cylinders ("active") which are in continuous operation and which vacuum provides the control signal determining the need for all- or half-cylinders-operation.

Control device 32 also includes a chamber 66 which is in open communication with a vacuum reservoir device 68. In the modification shown, vacuum reservoir device 68 is separate from the housing and is suitably secured thereto by a threaded stud member 70. The need for a manifold vacuum reservoir system comprised of chamber 66 and reservoir device 68 is to insure the maintenance of a manifold vacuum force adequate for proper actuation of shuttle 52 as will be considered subsequently in greater detail.

The communication system whereby active cylinder manifold vacuum is transmitted to chamber 66 and vacuum reservoir 68 will now be considered in detail by reference to FIGS. 1–5, 8 and 9. In order to sense the manifold vacuum extant in the "active" cylinder manifold and to thereby determine whether half- or all-cylinders-operation is desired, an opening 72 is formed in the wall of passage 14. Port or opening 72 in turn communicates with a passage 74 in the housing wall and through passages 76 and 78 in the housing cover 36. Cover passage 78 in turn communicates with shuttle passages 80 and 81 which again communicate with housing passages 82 and 84 opening to housing chamber 66 and vacuum reservoir 68. Housing chamber 66 then communicates with the vacuum chamber 64 defined by the end of shuttle 52 and housing cap 60 through housing passage 86, shuttle passage 85, and gaps *g*-G.

A first magnet device 90 is mounted within housing end cover 60 and is adapted to retain shuttle 52 at one end of its stroke under certain operating conditions. A second magnet device indicated generally at 92 and mounted within housing 34 is adapted to retain shuttle 52 in position at the other end of its travel. Inasmuch as the magnet devices 90 and 92 are of similar construction, it will only be necessary to describe the construction of one of these devices and the numerals applied to the other device will be designated by prime marks.

Since most permanent magnets are brittle and shuttle 52 moves at fairly high speeds, the kinetic energy of the shuttle at the end of its travel must be absorbed by an energy absorbing or dissipating bumper system which will now be described. For this purpose reference is made to FIGS. 2, 6, and 7 of the drawings. A permanent magnet 94 is suitably mounted on housing end plate 60 and is surrounded by a movable bumper member 96 which seats upon cover plate 60 through a resilient member 98. In assembling end plate 60 to housing 34, screws 62 are tightened sufficiently to compress resilient member 98 between the cap 60 and bumper member 96. As best seen in FIG. 2, a first gap or space *g* is formed between bumper 96 and cover 60. A second gap or space G is formed between magnet 94 and the end of shuttle 52. In order to prevent direct contact between magnet 94 and shuttle 52, space G is greater than space *g*. Bumper member 96 is preferably made of a low carbon steel while resilient member 98 is of a low resilience and absorbs the shuttle impact energy by compressing and through its internal friction in compressing delivers a greatly reduced force as it springs back and returns bumper 96 to its normal position. Such a bumper system must not only prevent damage to magnet 94 but also must absorb shuttle impact energy in such a way as to prevent any substantial bounce-back of the shuttle valve which could create a situation wherein the shuttle could undesirably hunt between its various flow control positions.

As a further means for absorbing the impact energy and prevent rebounding of the shuttle, it is possible to use a thin copper shim or plate 100 disposed between housing 34 and bumper members 96. By interposing copper shim 100 in the variable magnetic flux field, the kinetic energy of the shuttle is transformed into electricity and heat thereby further dissipating the impact energy of shuttle valve 52. As best seen in FIG. 7, copper shim 100 includes slotted portions 101 to permit vacuum in shuttle passage 85 to reach vacuum chamber 64.

A still further alternative for the dissipation of shuttle impact energy is illustrated in FIG. 6*a* and is achieved by eccentrically mounting magnet 94 relative to the centerline 102 of shuttle 52 and which eccentric mounting produces a mechanical couple causing the shuttle to drag against its housing guide to dissipate impact energy through the friction created.

As already noted, magnet device 92 is essentially the same as device 90 and the components thereof are identified by the appropriate primed numbers.

To reduce its mass, shuttle 52 may be fabricated from a variety of light materials such as aluminum. In such case, iron plates 104 and 106 are suitably affixed to the respective ends of shuttle 52 to assure magnetic attraction between the shuttle and devices 90 and 92.

While not shown in the drawings, an alternative to the use of magnet devices 90 and 92 could involve the use of detent devices. For example, a spring-biased detent could be mounted in a wall of casing 34 so as to be proximate shuttle valve 52 which would, in turn, have detent recesses formed therein. The detent recesses would be so positioned that when the detent engages therewith the shuttle valve would be releasably retained in either of its end positions.

While manifold vacuum moves shuttle 52 to one of its operative positions where it is retained by magnet device 90, as depicted in FIGS. 2 and 3, a second device is utilized to move the shuttle to its other extreme position where it is also retained by second magnet device 92. Reference is again made to FIG. 2 wherein this second means for powering shuttle 52 includes a lever 108 pivoted at end 110 to housing 34 and connected at its other end to shuttle 52 through a roller 112 disposed within shuttle recess 114 and retained therein by end plate 106. Lever 108 is powered by a spring 116 anchored at end 118 to housing 34 and connected at its other end to lever 108 intermediate its ends. Under conditions of no or low manifold vacuum, spring 116 moves shuttle 52 to the position shown in FIG. 5 where it is retained by second magnet device 92 until such time as an increase in "active" manifold vacuum causes a shifting of the shuttle to its other end position.

The general conditions will now be described for actuating shuttle 52 and changing the engine between a first state when all of the engine cylinders are delivering power and a second state in which the power is being provided by only half of the engine cylinders. Starting from that condition when the engine is inoperative, shuttle 52 is moved by spring 116 and lever 108 to the position shown in FIG. 5 and retained therein by second magnet 92. In this position shuttle valve opening 54 is in registry with common passage 120 and manifold intake passage 12. Thus, when the engine is started all cylinders are being fed with metered air and fuel from manifold passages 12 and 14.

After the engine starts and manifold vacuum reaches approximately 12" of Hg., and which manifold vacuum level will be hereinafter designated as $V_1$, the engine power requirements can be more economically met by changing to half-cylinders-operation. While any engine having an even number of cylinders may utilize the control system of this invention, for illustrative purposes the engine with which the aforedescribed system is utilized will be considered to be an eight-cylinder engine which will, therefore, be operating on either four or eight cylinders. The change from eight- to four-cylinders-operation will take place as follows. As already noted, all manifold vacuum signals will be generated in that part of the manifold, e.g. passage 14, which supplies those cylinders ("active") always in operation. Manifold vacuum, $V_1$, from manifold intake passage opening 72 is communicated to shuttle vacuum chamber 64 through passages 74 and 76 within housing 34, passages 76 and 78 within housing cover 36, then through shuttle passages 80' and 81', back to housing passages 82 and 84 to the vacuum chamber 66 and reservoir 68 and thence through passages 86 and 85 to vacuum chamber 64. Since housing chamber 44 is at ambient or essentially atmospheric pressure, shuttle valve 52 is exposed to a vacuum force, $V_1$, adequate to move the shuttle off of magnet device 92 and to overcome spring 116 acting through lever 108. As the shuttle is freed from the field of magnet device 92 and since the force $F_s$ of spring 116 is considerably less than vacuum force $V_1$, the shuttle valve will be moved by vacuum to the position of FIGS. 2 and 3 where magnet device 90 will hold the shuttle in the new position. In this position, shuttle valve lip 58 will block the flow of metered air from common passage 120 to manifold intake passage 12. At the same time, the flow of metered air from common passage 120 is all diverted so as to flow into "active" manifold intake passage 14.

During the movement of shuttle 52 from all- to half-cylinders-operation, flow through common passage 120 to manifold intake passage 12 is progressively eliminated. Thus vacuum $V_1$ drops to a lower value $V_2$ which is approximately 1/3 of $V_1$. Since the transient or differential vacuum $V_1$-$V_2$ would not be of sufficient force to carry the shuttle 52 to completion of its stroke, the initial vacuum $V_1$ is substantially preserved in vacuum reservoir system 66-68 by having vacuum passage 81' move off from all other vacuum passages. Thus, acting upon shuttle 52 throughout its transition from the position shown in FIG. 5 to that of FIG. 3 will be the difference between ambient or atmospheric pressure as exists in housing chamber 44 and the vacuum $V_1$ within housing chamber 66 and vacuum reservoir 68 the latter whose function is to limit any change of $V_1$ to that minor amount attributable to leakage and volume change of chamber 64 during the shuttle stroke. The volumetric capacity of housing chamber 66 and vacuum reservoir 68 is large enough to maintain adequate shuttle-actuating vacuum in shuttle chamber 64 even if moderate rebounding of shuttle 52 against bumper member 96 should occur. It is found that the transition of shuttle 52 from all- to half-cylinders-operation is accomplished in about one-half second.

Vacuum force $V_2$ plus field force of magnet device 90 are greater than spring force $F_s$ upon shuttle 52 causing the same to remain in its half-cylinder position, FIG. 3, until manifold vacuum at opening 72 drops to a value of approximately 4" or less Hg. designated by $V_3$.

$V_3$ is more vacuum than the beginning of mixture enrichment of a conventional carburetor and it is a convenient value at which to go to all-cylinders-operation at leaner and more economical mixtures.

In order to seal the various shuttle and housing vacuum passages so as to minimize leakage therearound, it is desirable to use an L-shape leaf spring 122 as shown in FIGS. 2-5. Spring 122 includes two lips 122*a* and 122*b* projecting between the shuttle 52 and guide walls 46 and 47 so as to bias the shuttle toward the housing vacuum passages and seal shuttle 52 to housing clearances.

In the illustrative graphs of FIGS. 16-21, the designations ACO and HCO refer respectively to "all-cylinders-operation" and "half-cylinders-operation". It was previously noted that vacuum $V_1$ at eight-cylinders-operation is such as to cause shuttle 52 to move toward its opposite or half-cylinders-operating position whereby vacuum drops to $V_2$ at manifold passage 72. As seen in FIG. 21, the relationship of vacuum $V_1$ and $V_2$ is such that at four-cylinders-operation engine torque $T_2$ at vacuum $V_2$ is slightly lower or equal to eight-cylinders-operation at torque $T_1$ and vacuum $V_1$. During four-cylinders-operation and in that condition where increased power dictates a return to all-cylinders-operation, engine torque $T_3$ is lower or equal to torque $T_4$ when the vacuum force is $V_3$ causing a reversal of the shuttle cycle and a return to full-cylinders-operation. FIG. 21 is intended to show the relationship of engine torque at the vacuum values which cause shuttle operation to occur. It is evident that every time the load upon the engine is low enough so that manifold vacuum equals or exceeds $V_1$, device 32 will automatically cause the engine to operate on half the cylinders and to thereby improve fuel economy. On the other hand, when the engine is operating on half its cylinders and the driver depresses the accelerator pedal to call for more power, the manifold vacuum drops to $V_3$ and thereby causes control device 32 to shift to all-cylinders-operation.

As already noted, when shuttle 52 is in the half-cylinders mode of FIG. 3, the metered air from common passage 120 is intercepted by the shuttle overhang or lip 58 which deflects the metered air through passage 40 to intake manifold 14. Conversely, when the shuttle is in its all-cylinders-operating mode, FIG. 5, metered air flows through common passage 120 to manifold intake passages 12 and 14. In accordance with the present invention the throttles 24 and 26 do not need repositioning during a steady-state shift and do not need interconnection to shuttle or manifold pressure sensors or actuators as has been done with prior art devices. The relationship of vacuums $V_1$ to $V_2$ is obtained when the throttle and engine speed are substantially fixed during the cycle which condition is called "steady-state".

At $V_1$ the metered air flowing from common passage 120 feeds all engine cylinders. At $V_2$ the metered air from common passage 120 only feeds the engine cylinders communicating with the "active" manifold inlet passage 14. If volumetric efficiency was constant the air flow would be one-half and the pressure drop through the carburetor would be approximately one-quarter of $V_1$. Actually, the volumetric efficiency of half-engine operation is considerably higher, thus the vacuum drop to $V_2$ is approximately 0.3 $V_1$ to 0.5 $V_1$. As also noted, the magnetic force of magnet device 90 on shuttle 52 plus vacuum $V_2$ are greater than the spring force $F_s$ upon the shuttle, thereby holding the system in this position for any vacuum in excess of $V_2$ and insuring half-engine operation at engine light loading. Further, not until the car driver opens the throttle sufficiently to drop the vacuum to $V_3$ or less will the reverse cycle, to all-cylinders-operation, take place.

Since four-cylinder torque at 4" Hg. vacuum is approximately equal to eight-cylinder torque at 12" Hg. vacuum, the control system of the present invention is able to make the transition without closing down carburetor passage 22 and thereby eliminates the necessity for mechanical interconnection between the throttles and the vacuum actuated shuttle 52 or its equivalent as shown in prior art devices.

While the basic operation of control device 32 has been described, there are numerous other operating conditions which have to be taken into account and provided for to insure proper operation of the system between all- and half-cylinders-operation.

As previously noted, shuttle 52 has an intermediate section or portion 56 which has a transient function between the two longitudinally extreme positions of the shuttle as shown in FIGS. 3 and 5. As seen in FIG. 4, shuttle portion 56 is adapted to simultaneously close common passage 120 from manifold intake passage 12 and substantially block communication of passage 12 with the atmosphere. Because of the relatively moderate speeds at which shuttle 52 operates, if portion 56 were not provided, several piston displacements would take place in which both atmospheric air and the fuel-/air mixture would mix causing an engine lean-out resulting in missing or backfiring of the engine. In other words, in order to assure a smooth transition between half- and all-cylinders-operation, it is undesirable to go directly from a condition in which a combustible mixture is flowing through manifold intake passage 12 immediately to a condition in which such passage is open to atmospheric air.

Figure 16:
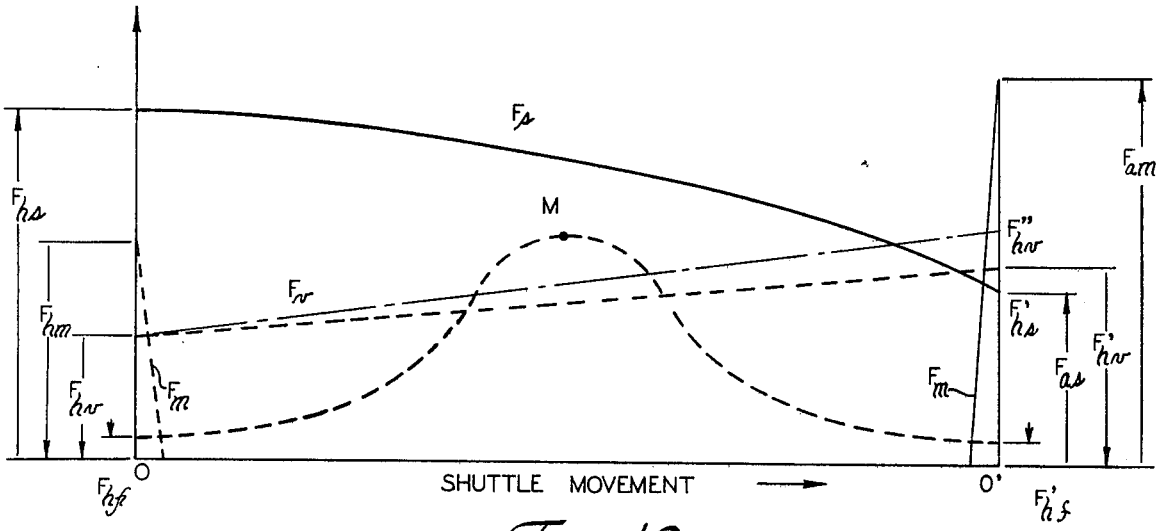

In utilizing a shuttle portion 56 to insure smooth transition between half- and all-cylinders-operation, certain other detrimental friction loads are imposed on shuttle 52 and which loads must be compensated for to permit proper shuttle operation. To better understand the problem and its solution, reference is now made to FIGS. 16—18 of the drawings. Reference is first made to FIG. 16 wherein the abscissa represents the movement of the shuttle from half-cylinders-operation to all-cylinders-operation and the ordinate represents the forces acting along the axis of the shuttle tending to move it or oppose its movement. At the beginning and at the end of each work diagram, the forces are illustrated as vectors. The downward vectors oppose shuttle motion while the upward vectors generate shuttle motion. The values of the vectors at the beginning of shuttle motion from half-cylinders-operation (HCO) have the suffix "h". At the end of shuttle operation a prime suffix is added. Forces for all-cylinders-operation (ACO) have the suffix "a". Forces at intermediate shuttle positions have only the suffix indicating the type of force. For example:

$F_s$ = spring force upon the shuttle.
$F_m$ = magnetic attractive force on the shuttle.
$F_f$ = friction of the system.
$F_v$ = vacuum suction force in the shuttle vacuum chamber face.

Still referring to FIG. 16, when due to engine loading requirements the vacuum decreases to $V_3$ during half-cylinders-operation, the resultant of all forces on the shuttle become 0. A further reduction of vacuum allows the spring force $F_{hs}$ to overcome the force of magnet device 90 thus causing a rapid cancellation of its magnetic attraction whereby the shuttle moves to the all-cylinders-operation position to the right of the diagram.

The diagram of FIG. 16 shows the spring force $F_s$ decreases from $F_{hs}$ to $F'_{hs}$ thus generating the positive work $W_s$ represented by the area O $F_{hs}$ $F'_{hs}$ O'.

Since this shuttle movement increases the volume of the system, the vacuum increases and with it the negative force upon the shuttle from $F_{hv}$ to $F'_{hv}$ and the corresponding work $W_v$ is represented by the area O $F_{hv}$ $F'_{hv}$ O'.

Figure 17:
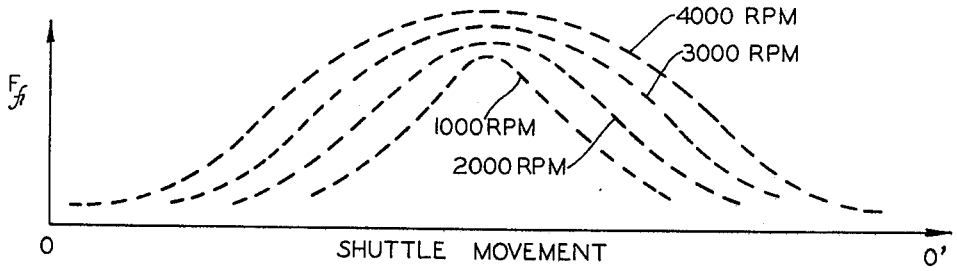

The friction forces acting on the shuttle at both ends of its travel are very small and are represented by the vectors $F_{hf}$ and $F'_{hf}$. However, when shuttle portion 56 transitionally blocks manifold inlet passage 12, the vacuum force beneath the shuttle portion 56 caused by the half cylinders being shut off is a maximum. Since the manifold vacuum communicating with the "active" cylinders, represented by the vacuum in manifold intake passage 14, is relatively low and the vacuum of the shut-off or "inactive" cylinders is high, the downward force, i.e. tending to force the shuttle toward the manifold, is high thereby causing the friction between shuttle 52 and housing 34 to react a maximum M. As the shuttle portion 56 traverses and communicates manifold intake passage 14 with the atmosphere, the friction level falls back to normal. The height and amplitude of peak M obviously increase with engine speed which relationship is shown in FIG. 17. Thus, the negative friction work $W_f$ is represented by the area O $F_{hf}$ M $F'_{hf}$ O' of FIG. 16 and such work would keep increasing with speed and would prevent functioning at such time as $W_s$ - $W_v$ - $W_f$ was equal to zero or negative.

In fact, leakage between the shuttle vacuum chamber 64 and manifold passage 12 boosts the vacuum $F_v$ as to $F''_{hv}$ (FIG. 16) and can thereby produce the condition of the above equation at rather moderate engine speeds for devices of limited shuttle cross-sectional area as often occurs with automotive applications.

The solution to this friction work force problem on shuttle 52 can be solved in one or a combination of ways as will be hereinafter described. First, shuttle 52 and housing cover 36 can be provided with rollers 124 and 125 rotatably mounted on shaft 128 and roller 126 on shaft 130. Each of the rollers projects very slightly beyond the shuttle or housing. As an alternative to the rollers, it is possible to utilize extremely low friction materials at the point of contact between the shuttle and the corresponding surface of the housing 34.

Figure 2A:
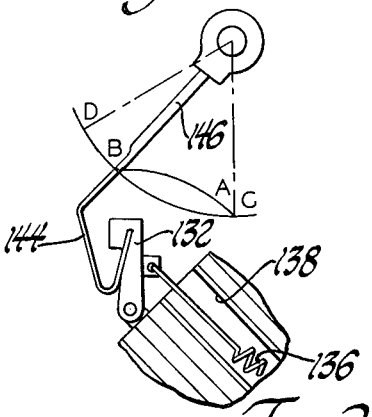
Figure 18:
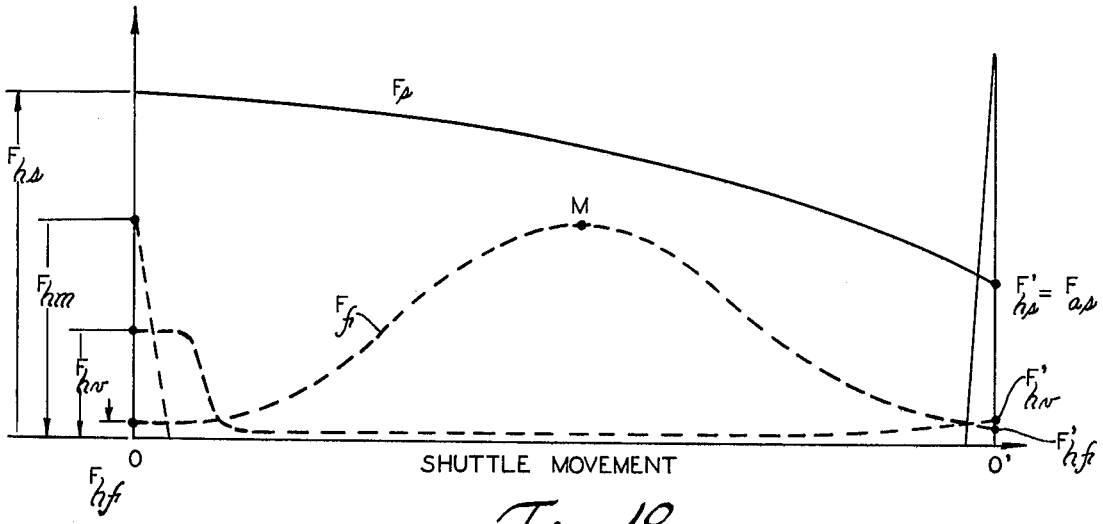

A still further solution to this friction problem is to eliminate or substantially reduce the negative work force $W_v$ (cylinders manifold vacuum) as shown in FIG. 18 and as represented by the work area O $F_{hv}$ $F'_{hv}$ O' which, as may be seen, reduces such force to close to 0. This result is achieved by incorporating an atmospheric swing valve 132 which is depicted in FIGS. 2 and 2a of the drawings. Swing valve 132 is pivoted at 134 and held is a closed position by a spring 136 thus blocking passages 138, 140, and 142 which communicate with housing vacuum chamber 66 and vacuum reservoir 68. Swing valve 132 is provided with a flexible member or finger 144 secured thereto and the free end of which will travel along an arc A-B when engaged by the outer end of a pin 146 fixed to and rotatable with shuttle operating lever 108.

The outer end of pin 146 describes an arc C-D and causes the valve to open up to point B of the latter's arc whereafter continued movement of lever 108 causes pin 146 to be disengaged from finger 144 allowing the valve to snap back to its seated or closed position as shown in FIG. 2. The aforementioned opening movement of atmospheric vent valve 132 takes place as the shuttle 52 moves from its half-cylinders-operating position of FIGS. 2 and 3 to the all-cylinders-operating position of FIG. 5. During the all-cylinders-operating mode and the shift from the all-cylinders-operating mode to the half-cylinders-operating mode, atmospheric valve 132 remains closed. Since member 144 has a downward flexibility, pin 146 deflects it and gets back of it at the end of the return motion from all- to half-cylinders-operation.

Since atmospheric valve 132 when open communicates with the atmospheric or ambient pressure space 44 of housing 34, as the atmospheric valve opens, the vacuum acting in shuttle vacuum chamber 64 is dropped almost to 0 for most of the shuttle travel as shown by the area O $F_{hv}$ $F'_{hv}$ O' of diagram 18. Thus, the resultant shuttle work remains positive up to the maximum engine speed and assures a good shift from half- to all-cylinders-operation.

The diagram of FIG. 19 represents the return motion of shuttle valve 52 from all-cylinders-operation (ACO) to half-cylinders-operation (HCO). When vacuum $V_1$ causes a force $F_{av}$ greater than the magnetic pull $F_{am}$, spring $F_{as}$ and friction $F_{af}$ shuttle 52 starts its motion toward its half-cylinders-operation position of FIGS. 2 and 3. In this case the positive work is supplied by the vacuum which decreases from its starting valve $V_1$ to $V'_1$. This decrease is caused by the compression action of the shuttle moving toward housing end cap 60 and air leaks between shuttle 52 and its guide walls 46, 47, 48 and cover 36. In fact, to prevent hydrocarbon losses to the atmosphere, leaks are only from the atmosphere into the system.

$V_1$ is relatively high (12" Hg. or more) and the work generated is adequate to overcome the negative work of the spring being tensioned and the friction generated by the downward force caused by the pressure differential across shuttle portion 56 as it traverses manifold intake passage 12. This pressure differential is less than the previous half-cylinders-operation to all-cylinders-operation shuttle movement. As the shuttle proceeds toward the position of FIGS. 2 and 3, a second friction peak M' occurs from the reversal of pressure differential as the shuttle causes the manifold vacuum to act against the shuttle causing the same to press against housing casing 34. The net work diagram goes to zero or a negative value only if the shuttle is manufactured with large air leakage, the shuttle is very small, or the friction coefficient between the shuttle and the housing is high. In such cases, a boost to the actuating vacuum acting in shuttle chamber 64 can be obtained by using a double-acting swing valve 150 of the type shown in FIGS. 12–15. In addition to having the same operational features as the atmospheric valve 132, double-action valve 150 additionally controls housing passages 152 and 154 between the "inactive" manifold 12 and the vacuum reservoir system 66–68. With the double-action swing valve 150 positioned against its seat, as during all-cylinders-operation to half-cylinders-operation, as the vacuum in the manifold becomes greater than the vacuum in the reservoir system 66–68, leaf spring check valve 156 opens communicating housing passage 154 with valve passage 158 and boosts the actuating vacuum to $V_c$ which is approximately equal to the maximum cylinder vacuum as depicted in FIG. 20 and thereby increasing the positive work produced to actuate shuttle 52.

At half-cylinders-operation, air flows from housing chamber 44 and underneath shuttle lip 58 to the "inactive" cylinder manifold passage 12. In this condition and as engine speed increases, the pressure drop increases between housing chamber 44 and shuttle face 160 causing an increase in suction force acting in the same direction as the force of return spring 116. When the vacuum force tending to hold the shuttle in its half-cylinders-operating condition approaches equality with the forces tending to shift the shuttle valve to its all-cylinders-operating condition, then the half-to-all-cylinders shift becomes unstable. Normally this condition is designed to occur at approximately 20% above the highway speed limit and is used to warn the driver to reduce speed. This generally unstable condition of the shuttle valve does not interfere with the normal availability of engine power which always becomes available by depressing the accelerator pedal.

Referring to FIGS. 10 and 11, air cleaner 30 is mounted on and delivers filtered air to carburetor 16. In order to assure a rapid warm-up of the engine which is particularly important during half-cylinders-operation (HCO), it is advisable to deliver pre-heated air to the air cleaner. To this end, a first air inlet 160 is provided and includes a hose 162 which is connected at its other end to a pre-heater around the engine exhaust manifold not shown. Second air inlets 164 and 166 are provided and admit unheated air. Baffles 168, 170, and 172 are provided within the air cleaner to prevent mixing of the preheated and unheated air streams prior to induction into carburetor 16.

A hose or pipe 174 also connects the filtered side of air cleaner 30 through control device 36 with atmospheric chamber 44.

The present invention is illustrated and described in the environment of an engine utilizing a carburetor 16 which supplies a combustible fuel/air mixture to intake manifold 10. However, the invention is intended to comprehend an air metering mechanism with appropriate throttle valve means and wherein the fuel is injected downstream of the air metering mechanism such as shown, for example, in my U.S. Pat. No. 2,878,798.

When running on split or half-cylinders-operation, see FIG. 1, the inactive intake manifold passage 12, being deprived of fuel and pumping to the atmosphere, becomes dry and would also tend to be cooled. Thus, upon the resumption of fuel/air mixture flow during all-cylinders-operation, fuel will tend to condense on the dry and cool walls of intake manifold passage 12 thereby providing an undesirable lean mixture to the "inactive" cylinders. To avoid such leaning of the mixture, the wall 178 of intake manifold 12 is exposed to exhaust manifold passage 180 to provide a hot surface against which the fuel stream impinges and is vaporized. In thus avoiding condensation of the fuel, a proper fuel/air mixture is maintained thereby facilitating a smooth transition to all-cylinders-operation.

It is desirable that the shift to half-cylinders-operation not occur until the engine is warm; otherwise engine operation tends to be rough. Therefore, engine temperature responsive means is provided to prevent the shift to the half-cylinders-operationmode until the engine is warm. To this end, a snap-action thermostatic valve 182 is mounted in casing 34 so as to block vacuum passage 84 until the engine is warm. Thus, even though the vacuum in "active" manifold passage 14 would be of a value to cause a shift of shuttle valve 52 to its half-cylinders-operation position, such shift cannot occur until the engine is warm enough to enable thermostatic valve 182 to snap to its open position as shown in FIG. 2.

Other modifications and variations may be made within the intended scope of the invention as set forth in the hereinafter appended claims.

What is claimed is:

1. A charge forming system for an internal combustion engine of the type comprising an intake manifold having first passage means communicating with one-half of the engine combustion chambers and second passage means communicating with the other half of the engine combustion chambers; an air metering mechanism having third passage means adapted to supply metered air to said first and second manifold passage means, and throttle valve means for controlling the flow of metered air through said air metering mechanism passage means; and a control device for interrupting the flow of metered air to said first manifold passage means whereby engine output power is generated only by those engine combustion chambers supplied by said second manifold passage means; the improvement comprising the control device having:

A. valve means disposed intermediate said first manifold passage means and said third passage means, said valve means including a first position allowing open communication between said first passage means and said third passage means, and a second position blocking flow between said first passage means and said third passage means while communicating the first passage means with ambient atmospheric pressure;

B. first actuating means for moving and maintaining said valve means in said first position;

C. second actuating means for moving and maintaining said valve means in said second position;

D. vacuum passage means communicating said second manifold passage means with said second actuating means whereby when the vacuum in said second manifold passage means reaches a predetermined value said second actuating means will act on the valve means with a force sufficient to overcome the force of said first actuating means to move the valve means to its second position wherein the flow of metered air to said first manifold passage means is cut off.

2. A charge forming system as set forth in claim 1 wherein said first actuating means includes a spring member biasing said valve means toward said first position, and means responsive to the vacuum in said vacuum passage means for shifting the valve means toward said second position.

3. A charge forming system as set forth in claim 2 wherein said control device includes an enclosed casing mounted between said air metering mechanism and said intake manifold, said casing including a fourth passage means aligned with and disposed intermediate said first manifold passage and said third passage means and a fifth passage means aligned with and continuously communicating said second manifold passage means with said third passage means, said valve means being slidably disposed in said casing means and adapted to control flow through said fourth casing passage means and said first manifold passage means, said valve means including a first portion having an opening therethrough, said spring member being adapted to shift said valve means to its first position thereby aligning said valve opening with said first manifold passage means and said third carburetor passage means, said valve means including a second portion adapted to block communication between said third carburetor passage means and said first manifold passage means while communicating said latter passage means to ambient atmospheric pressure, said manifold vacuum responsive means being adapted to move said valve means to said second position wherein said second valve portion blocks the flow between said third carburetor passage means and said first manifold passage means wherein engine power is supplied only by those engine combustion chambers communicating with said second manifold passage means.

4. A charge forming system as set forth in claim 3 wherein the vacuum responsive means comprises a vacuum chamber formed by said casing means and one end of said valve means, passage means communicating said second manifold passage means with the vacuum chamber of said control device, and a vent valve member operable by the movement of said valve means from its second toward its first position to open said vacuum passage means to ambient atmospheric pressure thereby facilitating the movement of the valve means to its first position.

5. A charge forming system for an internal combustion engine of the type comprising an intake manifold having first passage means communicating with one-half of the engine combustion chambers and second passage means communicating with the other half of the engine combustion chambers; an air metering mechanism having third passage means adapted to supply metered air to said first and second manifold passage means, and throttle valve means for controlling the flow of metered air through said third passage means; and a control device for interrupting the flow of metered air to said first manifold passage means whereby engine output power is generated only by those engine combustion chambers supplied by said second manifold passage means; the improvement comprising the control device having:

A. valve means disposed intermediate said first manifold passage means and said third passage means, said valve means including a first position allowing open communication between said first passage means and said third passage means, and a second position blocking flow between said first passage means and said third passage means while communicating the first passage means with ambient atmospheric pressure, and a third transient position intermediate said first and second positions wherein all flow to said first passage means is substantially blocked;

B. first actuating means for moving and maintaining said valve means in said first position;

C. second actuating means for moving and maintaining said valve means in said second position;

D. vacuum passage means communicating said second manifold passage means with said second actuating means whereby when the vacuum in said second manifold passage means reaches a predetermined value said second actuating means will act on the valve means with a force sufficient to overcome the force of said first actuating means to move the valve means to its second position wherein the flow of metered air to said first manifold passage means is cut off.

6. A charge forming system for an internal combustion engine comprising an intake manifold having first passage means communicating with one-half of the engine combustion chambers and second passage means communicating with the other half of the engine combustion chambers; an air metering mechanism having third passage means adapted to supply metered air to said first and second manifold passage means, and flow controlling throttle valve means disposed upstream of said first and second manifold passage means; and a control device of changing said engine from all-combustion-chambers-operation to half-combustion-chambers-operation, said control device including a valve means disposed intermediate said manifold and said air metering mechanism, means biasing the valve means to a first position permitting open communication between said third metering mechanism passage means and said first manifold passage means, a first supplemental means releasably retaining said valve means in its first position, means responsive to the vacuum in said second manifold passage means for shifting said valve means to a second position blocking flow from said third air metering mechanism passage means to said first manifold passage means when the vacuum in said second manifold passage means reaches a value sufficient to overcome the forces of said biasing means and said first supplemental means, and second supplemental means for releasably retaining said valve means in its second position.

7. A charge forming system as set forth in claim 2 wherein said control device includes an enclosed casing mounted between said carburetor device and said intake manifold, said casing including a fourth passage means aligned with and disposed intermediate said first manifold passage and said third metering mechanism passage means and a fifth passage means aligned with and continuously communicating said second manifold passage means with said third metering mechanism passage means, said valve means being slidably disposed in said casing means and adapted to control flow through said fourth casing passage means and said first manifold passage means, said valve means including a first portion having an opening therethrough, said spring member being adapted to shift said valve means to its first position thereby aligning said valve opening with said first manifold passage means and said third metering mechanism passage means, a first magnet device for releasably retaining said valve means in its first position, said valve means including a second portion adapted to block communication between said third metering mechanism passage means and said first manifold passage means while communicating said latter passage means to ambient atmospheric pressure, said manifold vacuum responsive means being adapted to move said valve means to said second position wherein said second valve portion blocks the flow between said third metering mechanism passage means and said first manifold passage means wherein engine power is supplied only by those engine combustion chambers communicating with said second manifold passage means, and a second magnet device for releasably retaining said valve means in its second position.

8. A charge forming system as set forth in claim 7 wherein each of said first and second magnet devices comprises a magnet member mounted on said casing in alignment with said slidable valve means, a bumper member movably mounted within said casing and surrounding said magnet member, and resilient means disposed between said casing and said bumper member, said resilient means biasing said bumper member beyond said magnet member so as to be engaged by said slidable valve means thereby preventing the latter from contacting said magnet member.

9. A charge forming system for an internal combustion engine comprising an intake manifold having first passage means communicating with one-half of the engine combustion chambers and second passage means communicating with the other half of the engine combustion chambers, an air metering mechanism having third passage means adapted to supply metered air to said first and second manifold passage means, and flow controlling throttle valve means for controlling flow through said third passage means, and a control device for changing said engine from all-combustion-chambers-operation to half-combustion-chambers-operation, said control device including a valve means disposed intermediate said manifold and said air metering mechanism, means biasing the valve means to a first position permitting open communication between said third passage means and said first manifold passage means, means responsive to the vacuum in said second manifold passage means for shifting said valve means to a second position blocking flow from said third passage means to said first manifold passage means when the vacuum in said second manifold passage means reaches a value sufficient to overcome the force of said biasing means, a crossover passage subadjacent said throttle valve means for delivering the metered air from said third passage means to said second manifold passage means when the valve means of said control device is in said second position.

10. A charge forming system for an internal combustion engine of the type comprising an intake manifold having first passage means communicating with one-half of the engine combustion chambers and second passage means communicating with the other half of the engine combustion chambers; an air metering mechanism having third passage means adapted to supply metered air to said first and second manifold passage means, and throttle valve means for controlling the flow of metered air through said third passage means; and a control device for interrupting the flow of metered air to said first manifold passage means whereby engine output power is generated only by those engine combustion chambers supplied by said second manifold passage means; the improvement comprising the control device having:

A. an enclosed casing disposed between said air metering mechanism and said intake manifold;

B. a shuttle valve slidably disposed within said casing, said shuttle valve being movable between a first position allowing open communication between said first passage means and said third passage means and a second position blocking flow between said first passage means and said third passage means while communicating the first passage means with ambient atmospheric pressure;

C. a spring actuated lever connected between the casing and the shuttle valve for moving said valve means to said first position;

D. a first device for releasably retaining said shuttle valve in said first position;

E. one end of said shuttle valve and said casing coacting to define a vacuum chamber;

F. vacuum passage means communicating said second manifold passage means with said vacuum chamber whereby when the vacuum in said second manifold passage means reaches a predetermined value said vacuum will act on the said one end of the shuttle valve with a force sufficient to overcome the force of said spring actuated lever and said first device to move the shuttle valve to a second position wherein the flow of metered air to said first manifold passage means is cut off; and G. a second device for releasably retaining the shuttle valve in its second position.

11. A charge forming system as set forth in claim 10 wherein said vacuum passage means includes: a vent passage adapted to open said vacuum chamber to the atmosphere, a valve element normally biased to a closed position to prevent communication of the vent passage to the atmosphere, said spring actuated lever including an arm adapted to engage and open said valve element as the shuttle valve is moved from said second position to said first position, said lever disengaging with said valve element as the shuttle approaches said first position enabling the valve element to close.

12. A charge forming system as set forth in claim 10 wherein said vacuum passage means includes: first conduit means communicating at one end with said second manifold passage means and terminating at the other end proximate said shuttle valve, second conduit means formed in said shuttle valve and adapted to register at one end with said first conduit means, third conduit means adapted to register at one end with the other end of said second conduit means and fourth conduit means formed in said shuttle valve in communication at one end with said vacuum chamber and communicating at the other end with the third conduit means, said second conduit means moving out of registry with said first conduit means as the shuttle valve moves from its second to its first position.

13. A charge forming system for an internal combustion engine of the type comprising an intake manifold having first passage means communicating with one-half of the engine combustion chambers and second passage means communicating with the other half of the engine combustion chambers; an air metering mechanism having third passage means adapted to supply metered air to said first and second manifold passage means, and throttle valve means for controlling the flow of metered air through said air metering mechanism passage means; and a control device for interrupting the flow of metered air to said first manifold passage means whereby engine output power is generated only by those engine combustion chambers supplied by said second manifold passage means, the improvement comprising the control device having:

A. an enclosed casing disposed intermediate said air metering mechanism and said intake manifold;

B. a shuttle valve slidably disposed within said casing, said shuttle valve being movable between a first position allowing open communication between said first passage means and said third passage means and a second position blocking flow between said first passage means and said third passage means while communicating the first passage means with ambient atmospheric pressure;

C. first actuating means for moving and maintaining said valve means in said first position;

D. second actuating means for moving and maintaining said valve means in said second position;

E. vacuum passage means communicating said second manifold passage means with said second actuating means whereby when the vacuum in said second manifold passage means reaches a predetermined value said second actuating means will act on the valve means with a force sufficient to overcome the force of said first actuating means to move the valve means to its second position wherein the flow of metered air to said first manifold passage means is cut off; and F. anti-friction means disposed between said shuttle valve and said casing to facilitate the sliding movement of said valve within said casing.

14. A charge forming system as set forth in claim 1 wherein each of said first and second actuating means includes a member for dissipating the impact energy of said valve means as it reaches its first and second positions.

15. A charge forming system as set forth in claim 1 wherein said vacuum passage means includes a reservoir for temporarily storing the vacuum force in said second manifold passage means when said valve means is in said first position.

16. A charge forming system as set forth in claim 15 wherein said shuttle valve means is adapted to interrupt communication between said second manifold passage means and the vacuum reservoir as said valve means moves from its first to its second position and to also interrupt said communication as the shuttle valve moves from the second to the first position.

17. A charge forming system as set forth in claim 16 wherein said vacuum passage means includes a vent passage adapted to open said vacuum reservoir to the atmosphere, a first valve element normally biased to a closed position to prevent communication of the vent passage to the atmosphere and a member adapted to engage and open the valve element as the valve means is moved from its second to its first position whereby the vacuum reservoir is vented to the atmosphere.

18. A charge forming system as set forth in claim 17 wherein said vent passage is adapted to communicate with a supplemental passage communicating with the first manifold passage means, a second valve element normally blocking communication between said supplemental passage and said first manifold passage means, said second valve element adapted to be opened when the vacuum force in said first manifold passage means exceeds the vacuum force in said vacuum reservoir.

19. A charge forming system for an internal combustion engine of the type comprising an intake manifold having first passage means communicating with one-half of the engine combustion chambers and second passage means communicating with the other half of the engine combustion chambers; an air metering mechanism having third passage means adapted to supply metered air to said first and second manifold passage means, and throttle valve means for controlling the flow of metered air through said air metering mechanism passage means; and a control device for interrupting the flow of metered air to said first manifold passage means whereby engine output power is generated only by those engine combustion chambers supplied by said second manifold passage means; the improvement comprising the control device having:

A. valve means disposed intermediate said first manifold passage means and said third passage means, said valve means including a first position allowing open communication between said first passage means and said third passage means, and a second position blocking flow between said first passage means and said third passage means while communicating the first passage means with ambient atmospheric pressure;

B. first actuating means for moving and maintaining said valve means in said first position;

C. second actuating means for moving and maintaining said valve means in said second position;

D. vacuum passage means communicating said second manifold passage means with said second actuating means whereby when the vacuum in said second manifold passage means reaches a predetermined value said second actuating means will act on the valve means with a force sufficient to overcome the force of said first actuating means to move the valve means to its second position wherein the flow of metered air to said first manifold passage means is cut off;

E. temperature responsive means coacting with the vacuum passage means to block communication between said second actuating means and said second manifold passage means to prevent movement of the valve means to its second position until the engine is warm.

20. A charge forming system for an internal combustion engine of the type comprising an exhaust manifold, an intake manifold having first passage means communicating with one-half of the engine combustion chambers and second passage means communicating with the other half of the engine combustion chambers; an air metering mechanism having third passage means adapted to supply metered air to said first and second manifold passage means, and throttle valve means for controlling the flow of metered air through said air metering mechanism passage means; and a control device for interrupting the flow of metered air to said first manifold passage means whereby engine output power is generated only by those engine combustion chambers supplied by said second manifold passage means; the improvement comprising the control device having:

A. valve means disposed intermediate said first manifold passage means and said third passage means, said valve means including a first position allowing open communication between said first passage means and said third passage means, and a second position blocking flow between said first passage means and said third passage means while communicating the first passage means with ambient atmospheric pressure;

B. first actuating means for moving and maintaining said valve means in said first position;

C. second actuating means for moving and maintaining said valve means in said second position;

D. vacuum passage means communicating said second manifold passage means with said second actuating means whereby when the vacuum in said second manifold passage means reaches a predetermined value said second actuating means will act on the valve means with a force sufficient to overcome the force of said first actuating means to move the valve means to its second position wherein the flow of metered air to said first manifold passage means is cut off.

E. said first intake manifold passage means including a wall portion exposed to said exhaust manifold to provide a hot area insuring vaporization of fuel introducted into the first manifold passage means.

* * * * *